US011925300B1

(12) United States Patent
Cabading

(10) Patent No.: US 11,925,300 B1
(45) Date of Patent: Mar. 12, 2024

(54) PERSONAL WIPING TOOL

(71) Applicant: Rea R. Cabading, Lahaina, HI (US)

(72) Inventor: Rea R. Cabading, Lahaina, HI (US)

( * ) Notice: Subject to any disclaimer, the term of this patent is extended or adjusted under 35 U.S.C. 154(b) by 530 days.

(21) Appl. No.: 17/179,010

(22) Filed: Feb. 18, 2021

Related U.S. Application Data

(60) Provisional application No. 62/977,880, filed on Feb. 18, 2020.

(51) Int. Cl.
*A47K 7/02* (2006.01)
*A47K 10/38* (2006.01)
*A47K 10/32* (2006.01)

(52) U.S. Cl.
CPC ..... *A47K 7/028* (2013.01); *A47K 10/38* (2013.01); *A47K 2010/3266* (2013.01)

(58) Field of Classification Search
CPC ..... A47K 7/00; A47K 7/02; A47K 7/028
See application file for complete search history.

(56) References Cited

U.S. PATENT DOCUMENTS

| | | | | |
|---|---|---|---|---|
| 2,998,614 | A | 9/1961 | Winch | |
| 5,067,194 | A | 11/1991 | Rosenfeld et al. | |
| 6,981,293 | B2 | 1/2006 | Steinberg | |
| 7,249,392 | B1 | 7/2007 | Paille | |
| 7,698,773 | B2 | 4/2010 | Sotelo | |
| 8,341,796 | B1 | 1/2013 | Rhee et al. | |
| 8,789,232 | B2 | 7/2014 | Sulliovan et al. | |
| 8,875,337 | B2 * | 11/2014 | Tacoma | B65D 71/06 15/210.1 |
| 8,925,137 | B1 | 1/2015 | Munoz | |
| 9,351,613 | B1 | 5/2016 | Tacoma | |
| D792,587 | S | 7/2017 | Owens et al. | |
| 10,327,600 | B1 | 6/2019 | Schimpf | |
| 2002/0108635 | A1 * | 8/2002 | Marrero | B64F 5/20 134/21 |

OTHER PUBLICATIONS

Self-Assist Toilet Medical Aids for Range of Motion Assistance—Long Reach—For Comfort Wipe (Color May Vary) by BodyHealt. Product Listing [online]. © 2021 Walmart [retrieved on Sep. 13, 2019]. Retrieved from the Internet: <URL: https://www.walmart.com/ip/Self-Assist-Toilet-Medical-Aids-for-Range-of-Motion-Assistance-Long-Reach-For-Comfort-Wipe-Color-May-Vary-by-BodyHealt/233690939?athcpid=233690939&athpgid=athenaltemPage&athcgid=null&athznid=PWVUB&athieid=v0&athstid=CS020&athguid=.

Juvo Toilet Aid—18" Long Reach Personal Wiping Aid with Hygienic Cover—Easy Use Comfort Self Wiper for Toileting, Use Toilet Paper or Wipes (SATA01). Product Listing [online]. © 1996-2021, Amazon.com, Inc. [retrieved on Sep. 13, 2019]. Retrieved from the Internet: <URL: https://www.amazon.com/gp/product/B0151FP9AY/ref=as_li_tl?e=UTF8&camp=1789&creative=9325&creativeASIN=B0151FP9AY&linkCode=as2&tag=christmashosiped-20&linkId= ed8bda8eec1b5a94dab03c03c83129f8>.

* cited by examiner

*Primary Examiner* — Michael D Jennings
(74) *Attorney, Agent, or Firm* — Cramer Patent & Design PLLC; Aaron R. Cramer

(57) ABSTRACT

A personal washing tool comprises a tool having a face and handle. The face comprises a reusable adhesive to which a wet wipe or disposable cloth are removable secured. The removable wipe or cloth portion of the tool may be actuated by either a push button mechanism or a sliding switch mechanism either of which are located on the handle. The wipe or cloth portion may be reloaded once a roll is empty and ejected from the handle.

20 Claims, 3 Drawing Sheets

PERSONAL WIPING TOOL

RELATED APPLICATIONS

The present invention is a continuation of, was first described in, and claims the benefit of U.S. Provisional Application No. 62/977,880 filed Feb. 18, 2020, the entire disclosures of which are incorporated herein by reference.

FIELD OF THE INVENTION

The present invention relates to a wiping tool and more specifically to a personal wiping tool.

BACKGROUND OF THE INVENTION

The need for maintaining personal hygiene is an important act a human can do. Historically, maintaining one's personal hygiene was discovered as a useful tool in warding off sickness and disease, while also enhancing one's means to find a mate. Often times, there are tools to facilitate this process, particularly in instances where areas of the body are hard to reach, particularly dirty, or if a caretaker is needed to provide the hygienic process. This is especially true with instances where incontinence issues arise and the need for a quick and on-the-spot personal hygiene is needed.

Such tools or implements can be either a single-use item or recyclable and reusable, depending on the material and area that is cleaned. Such tools can also be chosen for ease and simplicity of use, especially those without movable parts and that can be easily manufactured. Portable, easily concealed, and easily used, the personal wiping tool fulfills all these needs.

SUMMARY OF THE INVENTION

The principles of the present invention provide for a personal wiping tool, has a first housing portion which in turn has a first end and a second end, a second housing portion which has a first end and a second end, a third housing portion which has a first end and a second end, a roll of wipes which are positioned in a cylindrical orientation, a release mechanism which advances the roll of wipes off the personal wiping tool for subsequent disposal, an advancer which is located on an exterior of the first housing portion, a second slot which is located on the third housing portion at the first end thereof and extends forwardly, a pushing element which travels within the second slot, a rod having a first end and a second end, a washer affixed about an external circumference of the rod, a rod extender which has a first end and a second end, a first spring which is pushed by the advancer, the first spring resides within the first housing portion, and a second spring pushed by the washer.

The first housing portion serves as a handle. The first end of the first housing portion is affixed to and tapers away from the second end of the first housing portion. The third housing portion is affixed to and extends away from the second end of the second housing portion. The roll of wipes is wrapped around an outer circumference of the third housing portion. The advancer travels within a first slot located on the first housing portion to terminate prior to the second housing portion. The first slot and the second slot are aligned with each other. The pushing element is in mechanical communication with the advancer and the roll of wipes is wrapped around the third housing portion without covering the pushing element such that it cannot move, and a linear movement of the advancer transfers a linear movement to the pushing element. The rod is affixed to and driven by the advancer. The rod extender is attached to the second end of the rod that extends perpendicularly away. The second spring resides within the second housing portion and the first and second springs bias the advancer and the pushing element rearwardly toward the first ends of the first housing portion and third housing portions, respectively.

The first housing portion may be hollow. The first housing portion may include a knurled surface disposed on its exterior. The second end of the second housing portion may have a smaller diameter than the first end. The second end of the third housing portion may terminate in a bulbous tip to enable the roll of wipes to be easily and slidably removed from the personal wiping tool. The roll of wipes may be wrapped around at least once in order to be retained thereon.

The roll of wipes may include a plurality of moist towelettes. The roll of wipes may be wound about a piece of material selected from the group consisting of a piece of cardboard material, a piece of plastic material, or a piece of resilient material to retain its cylindrical tubular shape. The roll of wipes may be wrapped around at least once to be retained thereon. The personal wiping tool may be made of a material selected from the group consisting of a plastic material, a wooden material, a resilient material, or a rigid material.

In an alternate embodiment, the tool may have in lieu of the above advancement mechanism, a button which is located at a terminal end of the first housing portion. The button is seated within a first stop. The alternate embodiment may also have an alternate spring having a first end attached to an inner side of the button and a second end of the alternate spring is attached to the side of the second stop facing the first stop, a second stop which is located internally within the first housing portion and is oriented parallel to the first stop, an alternate rod which has a first end and is affixed to and driven by the button and a second end of the alternate rod which is attached to a first end of a rod extender that extends perpendicularly away therefrom, and a pushing element which is affixed to the second end of the rod extender. The pushing element travels within an alternate slot located on the third housing portion at the first end thereof and extending forwardly so a linear movement of the button transfers a linear movement to the pushing element.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
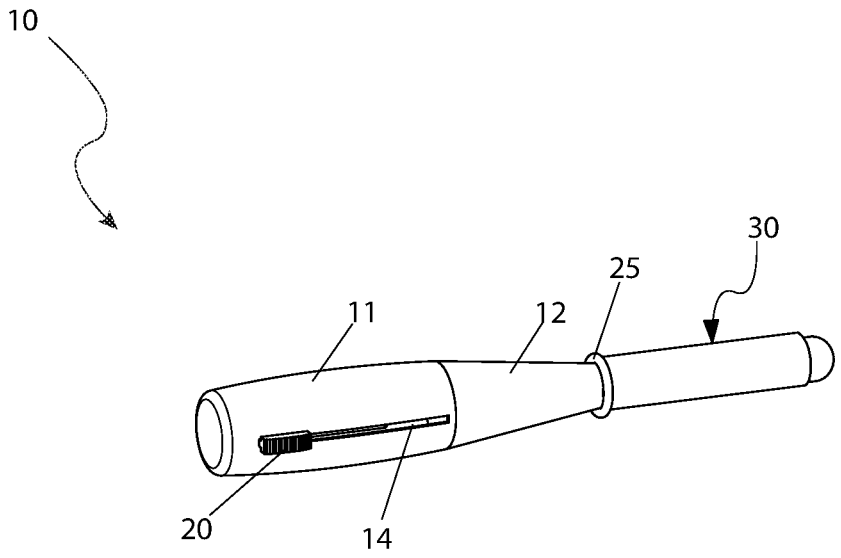
FIG. 1 is a front left perspective view of a personal wiping tool with a roll of wipes loaded on the tool, according to a preferred embodiment of the present invention.

10 personal wiping tool
11 first housing portion
12 second housing portion
13 third housing portion
14 first slot
15 second slot
16 grip
20 advancer
21*a* first spring
21*b* second spring
22 rod
23 washer
24 rod extension
25 pushing element
30 roll of wipes
50 alternate personal wiping tool
55 button
62 alternate rod
63 alternate spring
65 alternate slot
70 first stop
71 second stop

DESCRIPTION OF THE INVENTION

Figure 6:
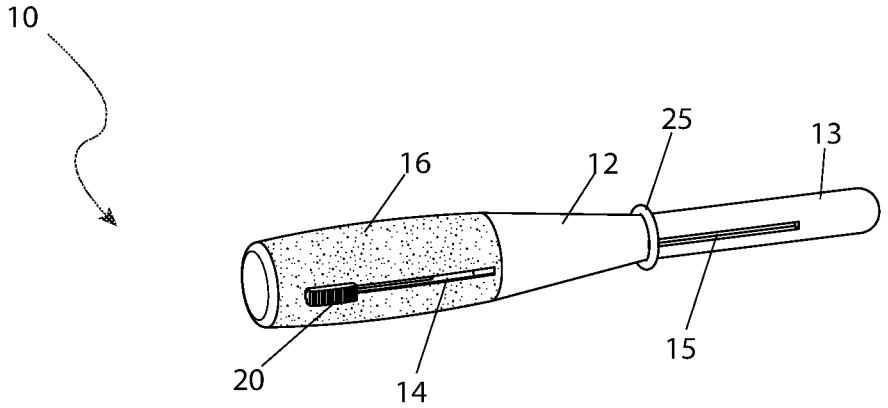
FIG. 6 is a front perspective view of a personal wiping tool with a grip, according to the preferred embodiment of the present invention.
Figure 7:
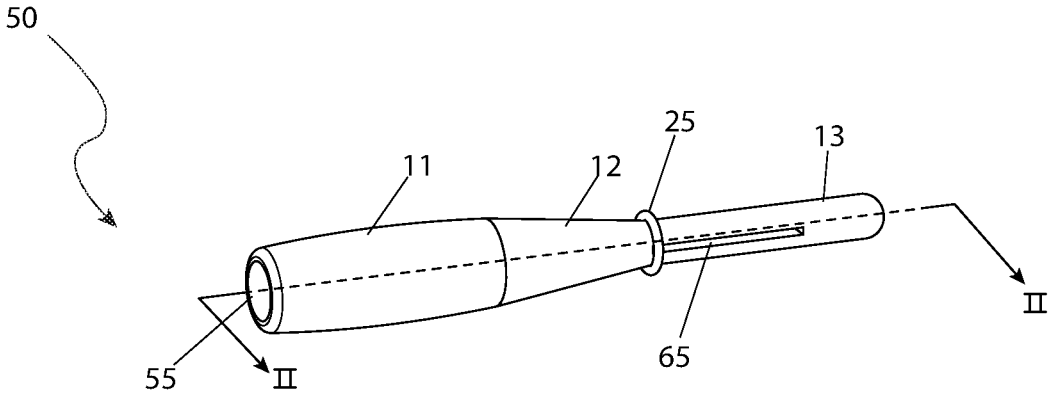
FIG. 7 is a front left perspective view of an alternate personal wiping tool with a roll of wipes loaded on the alternate tool, according to an alternate embodiment of the present invention.
Figure 8:
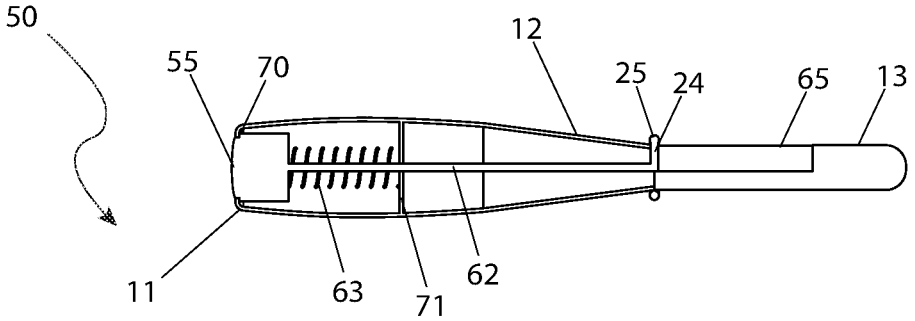
FIG. 8 is a cross-sectional view of the alternate personal wiping tool along the Lines II-II (please see FIG. 7), according to the alternate embodiment of the present invention.
Figure 9:
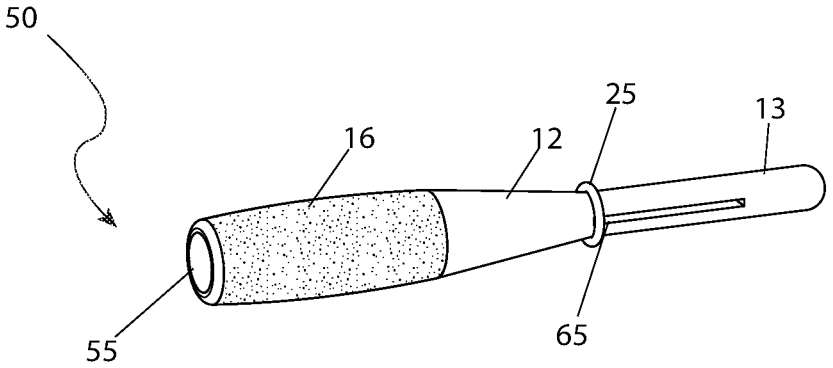
FIG. 9 is a front perspective view of the alternate personal wiping tool with a grip, according to the alternate embodiment of the present invention.

The best mode for carrying out the invention is presented in terms of its preferred embodiment, herein depicted within FIGS. 1 through 6, and alternately in FIGS. 7-9. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

The present invention relates to a personal wiping tool 10 that is capable of either single-use or repeated use. The personal wiping tool 10 is capable of retaining a roll of wipes 30, comprising at least one (1) ply fashioned as a moistened towelette or similar absorbent article in a cylindrical orientation. The overall size of the personal wiping tool 10 is cylindrical where the roll of wipes 30 may be wrapped around at least once or multiple times in order to be retained thereon. Preferably, the roll of wipes 30 can be wound about a cardboard, plastic, or other resilient material to retain its cylindrical tubular shape. After use, a release mechanism advances the roll of wipes 30 off the personal wiping tool 10 for subsequent disposal. A new roll of wipes 30 may be loaded on the personal wiping tool 10 or the personal wiping tool 10 can be a single-use device and disposed of as well. A particular article of construction of the personal wiping tool 10 can be plastic, wooden, or any other resilient and rigid material.

Referring now more closely to FIGS. 1 through 6, it is shown that the personal wiping tool 10 is particularly shaped as a cylindrical device with variable diameters. The overall size of the personal wiping tool 10 is approximately seven inches (7 in.) in length and one inch (1 in.) in diameter at its greatest dimension. The personal wiping tool 10 is composed of a first housing portion 11 having a first end and a second end. The first housing portion 11 is relatively hollow and composes the greatest diameter (e.g., one inch (1 in.)) and functions as a handle. A second housing portion 12 has a first end that is affixed to and tapers away from a second end of the first housing portion 11. The second housing portion 12 is also hollow. The second end of the second housing portion 12 has a smaller diameter than the first end thereof. A first end of a third housing portion 13 is affixed to and extends away from the second end of the second housing portion 12. The second end of the third housing portion 13 terminates in a bulbous tip. The roll of wipes 30 is suited to wrap around the outer circumference of the third housing portion 13.

Referring now to FIGS. 7-9, there is shown an alternate personal wiping tool 50 that enjoys the same overall shape and dimensions as described above, with relation to the first housing portion 11, second housing portion 12, and third housing portion 13. The roll of wipes 30 are similarly-sized, similarly-shaped and similarly-retained thereon.

Figure 2:
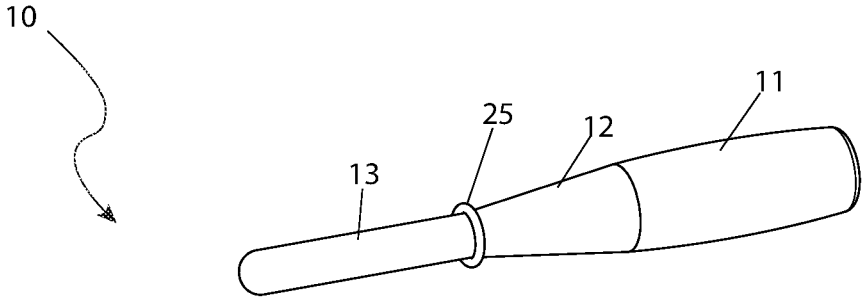
FIG. 2 is a rear right perspective view of the personal wiping tool, according to the preferred embodiment of the present invention.
Figure 4:
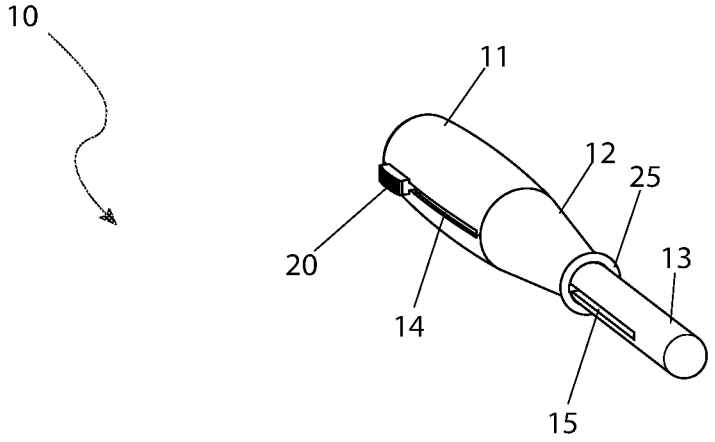
FIG. 4 is a right front perspective view of the personal wiping tool, according to the preferred embodiment of the present invention.
Figure 5:
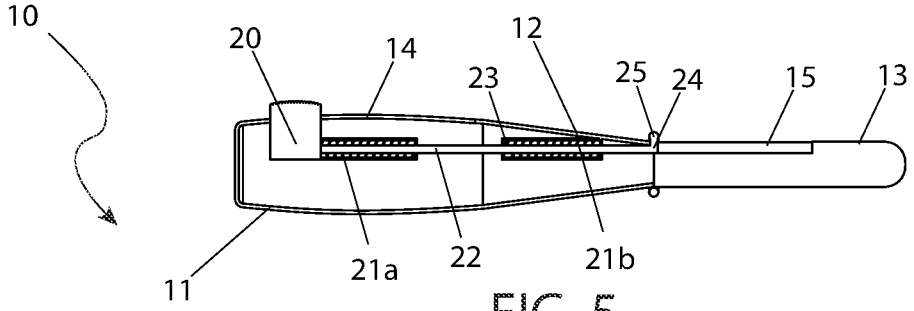
FIG. 5 is a cross-sectional view of the personal wiping tool along the Lines I-I (please see FIG. 2), according to the preferred embodiment of the present invention.

Referring now back to the preferred personal wiping tool 10, an advancer 20 is located on an exterior of the first housing portion 11 and travels within a first slot 14, also located on the first housing portion 11 to terminate prior to the second housing portion 12. A second slot 15 is located on the third housing portion 13 at the first end thereof and extends forwardly. The first slot 14 and second slot 15 are aligned with each other. A pushing element 25 travels within the second slot 15 and is in mechanical communication with the advancer 20. The roll of wipes 30 is wrapped around the third housing portion 13 without covering the pushing element 25 such that it cannot move. The bulbous tip enables the roll of wipes 30 to be easily and slidably removed from the personal wiping tool 10 as shown by FIG. 2.

Figure 3:
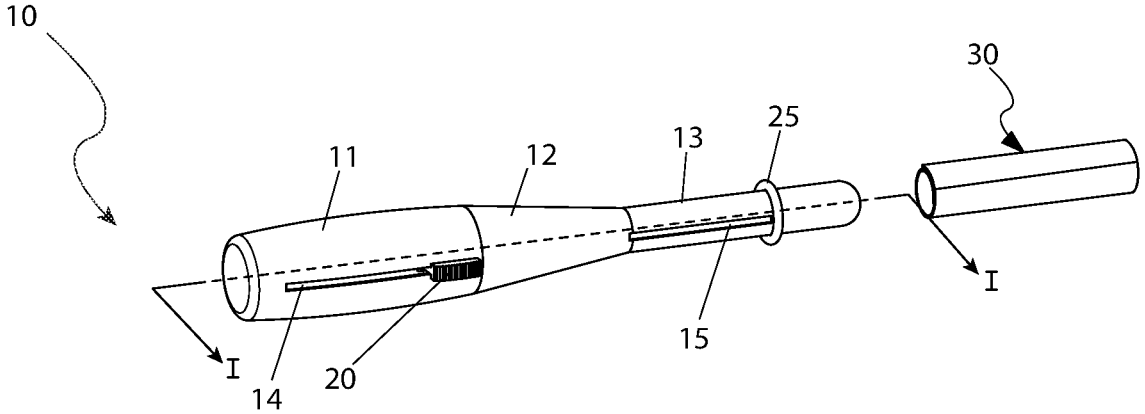
FIG. 3 is a front left perspective view of the personal wiping tool with the roll of wipes ejected from the tool, according to the preferred embodiment of the present invention.

Referring now to FIG. 3, it is shown that the advancer 20 extends within the first housing portion 11 and a portion resides outside of the first housing portion 11. The portion that resides outside of the first housing portion 11 may be textured or have a knurled surface. A first end of a rod 22 is affixed to and driven by the advancer 20. The rod 22 may be cylindrical or a rectangular prism. A washer 23 is affixed about an external circumference of the rod 22. Attached to a second end of the rod 22 is a first end of a rod extender 24 that extends perpendicularly away therefrom. A second end of the rod extender 24 is affixed to the pushing element 25. As such, a linear movement of the advancer 20 transfers a linear movement to the pushing element 25. A first spring

21*a* is pushed by the advancer 20 and a second spring 21*b* is pushed by the washer 23. The first and second springs 21*a*, 21*b* bias the advancer 20, and thus the pushing element 25 rearwardly (i.e., toward the first ends of the first housing portion 11 and third housing portions 13, respectively). The first spring 21*a* resides within the first housing portion 11 and the second spring 21*b* resides within the second housing portion 12.

During use of the personal wiping tool 10, the user may attach a roll of wipes 30 to the third housing portion 13, between the terminal part thereof and the pushing element 25 and not covering the pushing element 25. The user then directs the roll of wipes 30 onto the desired body part that needs to be cleaned. Once the cleaning act is complete, the user then manipulates the advancer 20 towards the second housing portion 12, which in turn drives the pushing element 25 to contact and push the roll of wipes 30 off of the third housing portion 13. This movement can be directed over the toilet, if the roll of wipes 30 are to be flushed into the plumbing, or over a trash receptacle. Release of the advancer 20 returns the advancer 20 towards the first end of the first housing portion 11 and the pushing element 35 rearwardly towards the first end of the third housing portion 13 so that a new roll of wipes 30 can be placed on the third housing portion 13 for subsequent use.

Referring now to FIGS. 7-9, the alternate personal wiping tool 50 is shown. As aforementioned, the overall size and shape of the alternate personal wiping tool 50 is generally identical to the preferred personal wiping tool 10. Replacing the advancer 20 is a button 55 which is located at the terminal end of the first housing portion 55. The button 55 is seated within a first stop 70. A first end of an alternate spring 63 is attached to the inner side of the button 55. A second stop 71 is located internally within the first housing portion 11 and is oriented parallel to the first stop 70. A second end of the alternate spring 63 is attached to the side of the second stop 71 facing the first stop 70. A first end of an alternate rod 62 is affixed to and driven by the button 55. The rod 22 may be cylindrical or a rectangular prism. Attached to a second end of the alternate rod 62 is a first end of a rod extender 24 that extends perpendicularly away therefrom. A second end of the rod extender 24 is affixed to the pushing element 25. The pushing element 25 travels within an alternate slot 65 located on the third housing portion 13 at the first end thereof and extending forwardly. As such, a linear movement of the button 55 transfers a linear movement to the pushing element 25. The alternate spring 63 biases the button 55, and thus the pushing element 25 rearwardly (i.e., toward the first ends of the first housing portion 11 and third housing portions 13, respectively). The bulbous tip enables the roll of wipes 30 to be easily and slidably removed from the personal wiping tool 10.

During use of the alternate personal wiping tool 50, the user may attach a roll of wipes 30 to the third housing portion 13, between the terminal part thereof and the pushing element 25 and not covering the pushing element 25. The user then directs the roll of wipes 30 onto the desired body part that needs to be cleaned. Once the cleaning act is complete, the user then manipulates the button 55 towards the second housing portion 12, which in turn drives the pushing element 25 to contact and push the roll of wipes 30 off of the third housing portion 13. This movement can be directed over the toilet, if the roll of wipes 30 are to be flushed into the plumbing, or over a trash receptacle. Release of the button 55 returns the button 55 to seat within the first stop 70 and the pushing element 35 rearwardly towards the first end of the third housing portion 13 so that a new roll of wipes 30 can be placed on the third housing portion 13 for subsequent use.

Other embodiments of the present invention may provide for the first housing portion 11 to have a grip 16 or otherwise ergonomic grasping means thereto. The grip 16 is preferably affixed to or an integral part of the first housing portion 11 and is illustrated as present in either embodiment (the preferred personal wiping tool 10 as seen in FIG. 6 and the alternate personal wiping tool 50 as seen in FIG. 9). The personal wiping tool 10 and roll of wipes 30 can also be manufactured out of a biodegradable material.

What is claimed is:

1. A personal wiping tool, comprising:

a first housing portion having a first end and a second end, the first housing portion serves as a handle;

a second housing portion having a first end and a second end, the first end of the first housing portion is affixed to and tapers away from the second end of the first housing portion;

a third housing portion having a first end and a second end, the third housing portion is affixed to and extends away from the second end of the second housing portion;

a roll of wipes positioned in a cylindrical orientation, the roll of wipes is wrapped around an outer circumference of the third housing portion;

a release mechanism advancing the roll of wipes off the personal wiping tool for subsequent disposal;

an advancer located on an exterior of the first housing portion, the advancer travels within a first slot located on the first housing portion to terminate prior to the second housing portion;

a second slot located on the third housing portion at the first end thereof and extends forwardly, the first slot and the second slot are aligned with each other;

a pushing element travels within the second slot, the pushing element is in mechanical communication with the advancer and the roll of wipes is wrapped around the third housing portion without covering the pushing element such that it cannot move and a linear movement of the advancer transfers a linear movement to the pushing element;

a rod having a first end and a second end, the rod is affixed to and driven by the advancer;

a washer affixed about an external circumference of the rod;

a rod extender having a first end and a second end, the rod extender is attached to the second end of the rod that extends perpendicularly away therefrom;

a first spring pushed by the advancer, the first spring resides within the first housing portion; and a second spring pushed by the washer, the second spring resides within the second housing portion and the first and second springs bias the advancer and the pushing element rearwardly toward the first ends of the first housing portion and third housing portions respectively.

2. The personal wiping tool, according to claim 1, wherein the first housing portion is hollow.

3. The personal wiping tool, according to claim 1, wherein the first housing portion includes a knurled surface disposed on its exterior.

4. The personal wiping tool, according to claim 1, wherein the second end of the second housing portion has a smaller diameter than the first end thereof.

5. The personal wiping tool, according to claim 1, wherein the second end of the third housing portion terminates in a bulbous tip to enable the roll of wipes to be easily and slidably removed from the personal wiping tool.

6. The personal wiping tool, according to claim 1, wherein the roll of wipes are wrapped around at least once in order to be retained thereon.

7. The personal wiping tool, according to claim 1, wherein the roll of wipes includes a plurality of moist towelettes.

8. The personal wiping tool, according to claim 1, wherein the roll of wipes are wound about a piece of material selected from the group consisting of a piece of cardboard material, a piece of plastic material, or a piece of resilient material to retain its cylindrical tubular shape.

9. The personal wiping tool, according to claim 1, wherein the roll of wipes are wrapped around at least once to be retained thereon.

10. The personal wiping tool, according to claim 1, wherein the personal wiping tool is made of a material selected from the group consisting of a plastic material, a wooden material, a resilient material, or a rigid material.

11. A personal wiping tool, comprising:

a first housing portion having a first end and a second end, the first housing portion serves as a handle;

a second housing portion having a first end and a second end, the first end of the first housing portion is affixed to and tapers away from the second end of the first housing portion;

a third housing portion having a first end and a second end, the third housing portion is affixed to and extends away from the second end of the second housing portion;

a roll of wipes positioned in a cylindrical orientation, the roll of wipes is wrapped around an outer circumference of the third housing portion;

a release mechanism advancing the roll of wipes off the personal wiping tool for subsequent disposal;

a button located at a terminal end of the first housing portion, the button is seated within a first stop;

an alternate spring having a first end attached to an inner side of the button and a second end of the alternate spring is attached to the side of the second stop facing the first stop;

a second stop located internally within the first housing portion and is oriented parallel to the first stop;

an alternate rod having a first end is affixed to and driven by the button and a second end of the alternate rod attached to a first end of a rod extender that extends perpendicularly away therefrom; and a pushing element is affixed to the second end of the rod extender, the pushing element travels within an alternate slot located on the third housing portion at the first end thereof and extending forwardly so a linear movement of the button transfers a linear movement to the pushing element.

12. The personal wiping tool, according to claim 11, wherein the first housing portion is hollow.

13. The personal wiping tool, according to claim 11, wherein the first housing portion includes a knurled surface disposed on its exterior.

14. The personal wiping tool, according to claim 11, wherein the second end of the second housing portion has a smaller diameter than the first end thereof.

15. The personal wiping tool, according to claim 11, wherein the second end of the third housing portion terminates in a bulbous tip to enable the roll of wipes to be easily and slidably removed from the personal wiping tool.

16. The personal wiping tool, according to claim 11, wherein the roll of wipes are wrapped around at least once in order to be retained thereon.

17. The personal wiping tool, according to claim 11, wherein the roll of wipes includes a plurality of moist towelettes.

18. The personal wiping tool, according to claim 11, wherein the roll of wipes are wound about a piece of material selected from the group consisting of a piece of cardboard material, a piece of plastic material, or a piece of resilient material to retain its cylindrical tubular shape.

19. The personal wiping tool, according to claim 11, wherein the roll of wipes are wrapped around at least once to be retained thereon.

20. The personal wiping tool, according to claim 11, wherein the personal wiping tool is made of a material selected from the group consisting of a plastic material, a wooden material, a resilient material, or a rigid material.

* * * * *